US010328335B1

(12) United States Patent
Elwin et al.

(10) Patent No.: US 10,328,335 B1
(45) Date of Patent: Jun. 25, 2019

(54) OMNIDIRECTIONAL TARGET FOR AN AMUSEMENT GAME DEVICE

(71) Applicant: Stern Pinball, Inc., Elk Grove Village, IL (US)

(72) Inventors: Keith Elwin, Park Ridge, IL (US); John Harrison Drake, Jr., Arlington Heights, IL (US)

(73) Assignee: Stern Pinball, Inc., Elk Grove Village, IL (US)

( * ) Notice: Subject to any disclaimer, the term of this patent is extended or adjusted under 35 U.S.C. 154(b) by 0 days.

(21) Appl. No.: 15/906,068

(22) Filed: Feb. 27, 2018

(51) Int. Cl.

| | |
|---|---|
| ***A63F 7/26*** | (2006.01) |
| ***A63F 7/24*** | (2006.01) |
| ***G07F 17/32*** | (2006.01) |
| ***A63F 7/02*** | (2006.01) |

(52) U.S. Cl.
CPC ..... *A63F 7/2409* (2013.01); *A63F 7/027* (2013.01); *G07F 17/3295* (2013.01)

(58) Field of Classification Search
CPC ..... A63F 7/2409; A63F 7/027; A63F 7/025; A63F 7/22; A63F 7/26; A63F 7/30; G07F 17/3295; G07F 17/3286
See application file for complete search history.

(56) References Cited

U.S. PATENT DOCUMENTS 2,163,122 A * 6/1939 Hooker ..... A63F 7/3065 200/61.11
2,212,097 A * 8/1940 Gensburg ..... A63F 7/3065 200/61.11
2,275,005 A * 3/1942 Bevington ..... A63F 7/3065 200/61.11
2,277,274 A * 3/1942 Stoner ..... A63F 7/3065 200/61.11
2,302,184 A * 11/1942 Caestecker ..... A63F 7/307 200/61.11
2,311,392 A * 2/1943 Heiss ..... A63F 7/307 200/61.11
2,727,743 A * 12/1955 Von Stoeser ..... A63F 7/3075 200/61.11
2,804,514 A * 8/1957 Peters ..... A63F 7/307 200/61.11
4,203,602 A * 5/1980 Kral ..... A63F 7/3075 273/121 A
4,354,681 A 10/1982 Garbark
5,044,635 A 9/1991 Oermann
5,123,647 A * 6/1992 Lawlor ..... A63F 7/3065 273/121 A (Continued)

*Primary Examiner* — Raleigh W Chiu
(74) *Attorney, Agent, or Firm* — Greenberg Traurig, LLP

(57) ABSTRACT

A target assembly includes a target post mounted to an underside of a playfield and sized to extend through an opening in the playfield. A centering device is mounted to the target post between a first end of the target post and a second end of the target post and a centering plate secures the target post to the underside of the playfield, wherein the centerplate and the centering device form a fulcrum for the target post to pivot as a lever. Impact of a ball with any portion of the target post, and in any direction, above the playfield causes the target post to pivot about the fulcrum, where a sensing switch senses the target post movement. A biasing element coupled to the centering device biases the target post into a rest position and returns the impacted target lever towards the rest position after impact by the ball.

21 Claims, 7 Drawing Sheets

(56) References Cited

U.S. PATENT DOCUMENTS

| | | | | |
|---|---|---|---|---|
| 5,338,031 | A | 8/1994 | Patla, Sr. et al. | |
| 5,358,244 | A * | 10/1994 | Kaminkow | A63F 7/027 273/118 A |
| 5,992,848 | A * | 11/1999 | Krutsch | A63F 7/027 273/118 R |
| 6,158,737 | A | 12/2000 | Cornell et al. | |
| 6,573,465 | B1 * | 6/2003 | Doepner | A63F 7/307 200/43.04 |
| 6,630,635 | B1 * | 10/2003 | Doepner | A63F 7/307 200/6 A |
| 2007/0026918 | A1 | 2/2007 | Sheats, Jr. | |
| 2016/0121202 | A1 * | 5/2016 | Gomez | A63F 7/027 273/121 R |
| 2018/0290050 | A1 * | 10/2018 | Gomez | A63F 7/027 |

* cited by examiner

OMNIDIRECTIONAL TARGET FOR AN AMUSEMENT GAME DEVICE

FIELD OF THE DISCLOSURE

The present description relates generally to amusement games and more particularly to an omnidirectional target for an amusement game device.

BACKGROUND

Amusement game devices, such as pinball machines, redemption games, etc. of the commercial, e.g., revenue generating, and non-commercial, e.g., home entertainment, type are well known in the art. By way of example, U.S. Pat. Nos. 5,338,031, 6,158,737, and U.S. Published Application No. 2007/0026918 illustrate and describe amusement game devices of the type having a cabinet which houses a playfield.

Various targets and bumpers for use on the playfield of such amusement game devices are also generally known in the art. By way of example, a traditional pinball standup target includes a vertically positioned spot target coupled to a suitable switch located above the playfield. The target assembly is mounted to the playfield such that when the target is contacted by a ball in a particular, limited direction, the target actuates the leaf switch to register a ball contact. Any contact with the switch from another direction may not actuate the target sufficiently to trigger the sensing switch.

In addition, U.S. Pat. No. 4,354,681 ("the '681 patent") describes a drop target assembly providing multiple target surfaces at a given drop target location. First and second target surfaces respectively are provided on first and second support members disposed in alignment such that the first member is in front of the second member, and the first target surface is in front of and shields the second target surface when the members maintain both targets in the above-playfield position. The first member is vertically moveable to drop the first target surface to a below-playfield position. This exposes the second target surface for ball engagement. A pair of switch contacts is provided behind the second target surface such that ball engagement of either the first target surface or the second target surface closes the switch contacts.

Yet further, U.S. Pat. No. 5,044,635 ("the '635 patent") describes a "pop bumper" for a pinball game which carries a depressible flange for contact with a rolling ball. A vertically moveable pin engages the flange and is positioned to move in linear manner between a first vertical position when the flange is depressed and a second vertical position when the flange is not depressed. A spring is provided to urge the vertically movable pin toward one of the vertical positions, typically the second vertical position. A switch is actuated between open and closed positions as the pin moves between the first and second vertical positions. A ball thruster may be provided to thrust the ball away from the bumper when the vertically moveable pin is moved to typically the first vertical position in which the flange is depressed.

While the various targets and bumpers, such as those described above, generally work for their intended purpose, there is an identifiable desire for improvements to target construction and resultant gameplay. For instance, the present invention provides for a target mechanism that detects hits from a pinball regardless of what direction it is struck from, while minimizing component parts and/or component wear by locating a majority of components below the playfield.

SUMMARY

The following describes an improved omnidirectional target assembly for an amusement game. Generally, the target assembly includes a target post mounted to an underside of a playfield and sized to extend through an opening in the playfield. A centering device is mounted to the target post between a first end of the target post and a second end of the target post and a centering plate secures the target post to the underside of the playfield, wherein the centerplate and the centering device form a fulcrum for the target post to pivot as a lever. Impact of a ball with any portion of the target post, and in any direction, above the playfield causes the target post to pivot about the fulcrum, where a sensing switch senses the target post movement. A biasing element coupled to the centering device biases the target post into a rest position and returns the impacted target lever towards the rest position after impact by the ball.

A better understanding of the objects, advantages, features, properties and relationships of the subject omnidirectional target assembly will be obtained from the following detailed description and accompanying drawings which set forth illustrative examples, which are indicative of the various ways in which the principles of the omnidirectional target assembly may be employed.

BRIEF DESCRIPTION OF THE DRAWINGS

For a better understanding of omnidirectional target assembly disclosed hereinafter reference may be had to the following drawings.

DETAILED DESCRIPTION

The following description of example methods and apparatus is not intended to limit the scope of the description to the precise form or forms detailed herein. Instead the following description is intended to be illustrative so that others may follow its teachings.

With reference to the figures, an amusement game device, in the example form of a pinball machine 10 is now described. It is to be appreciated, however, that this example form for the amusement game device is not intended to be limiting. Rather, those of ordinary skill in the art will appreciated that the omnidirectional target assembly disclosed hereinafter can be utilized in any type of amusement game device of the commercial and non-commercial type in which it is desired to sense an object contact with a target switch from any direction.

Figure 1:
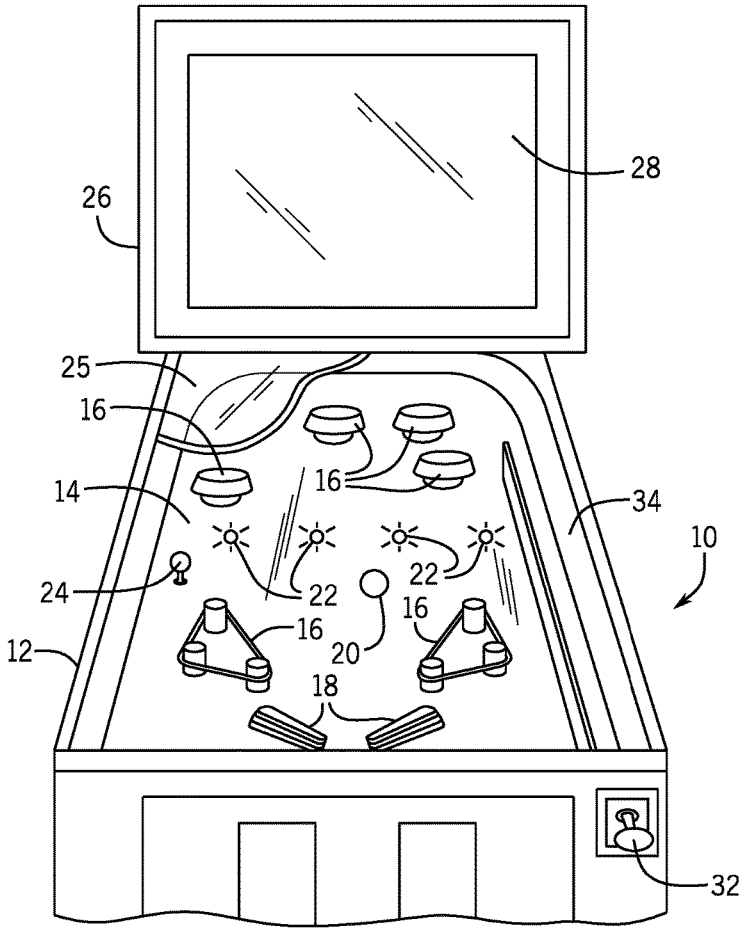
FIG. 1 illustrates an example amusement game device in the form of a pinball machine.

The example pinball machine 10 illustrated in FIG. 1 includes a cabinet 12 which houses various apparatus used to define play of a game. Game play may be commenced in response to insertion of money—paper or coins referred to collectively as "coins"—into a coin accepting device, upon exercising of credits earned, by accepting payment from an account, e.g., via use of a swipe card reading device, a bar code reading device, a near field communications device, etc., and/or by otherwise making game play active. Upon activation of the game in this manner, game play, in the case of the example pinball machine 10, is defined upon an inclined playfield 14 that supports a number of playfield accessories or devices.

More particularly, in the case of the example pinball machine 10, game play is generally defined through the use of a pair of flippers 18 to propel a ball 20 relative to an upperside (e.g., a first surface) of the playfield 14 and input devices/accessories associated with the playfield 14. The playfield 14 is usually inclined from the horizontal such that the ball tends to eventually roll back down the playfield 14 in the direction of the flippers 18. While not intended to be limiting, the playfield accessories or input devices may include elements such as bumpers 16, ramps, rollover switches 22, and/or at least one target assembly 24 which will be described in greater detail hereinafter.

The playfield 14 may be covered by a transparent or glass sheet cover 25 to permit viewing of the playfield 14. In addition to the foregoing, the playfield 14 typically includes a plunger element 32 which shoots or launches the ball 20 up an alley 34 onto the playfield 14. The playfield 14 may also include lighting elements—which may also be included as a part of the any of the input devices/accessories—and/or other features as desired. Other player-activated input elements, typically in the form of push-buttons (not shown) on the sides of the cabinet 12, are usually provided for controlling operation of the flippers 18. The amusement game 10 may also include a backbox 26 which is mounted to overlay a top rear portion of the cabinet 12 and which contains a game display 28, such as a dot matrix display, CRT, LED or plasma display, or the like. The backbox 26 may also support speakers associated with the game sound system. Within the backbox 26 may be located various ones of the electronic devices/circuits for controlling the operation of the playfield 14, the display 28, general illumination, and the sound system. Such electronic devices/circuits could also, in whole or in part, be carried within the game cabinet 12.

Figure 2:
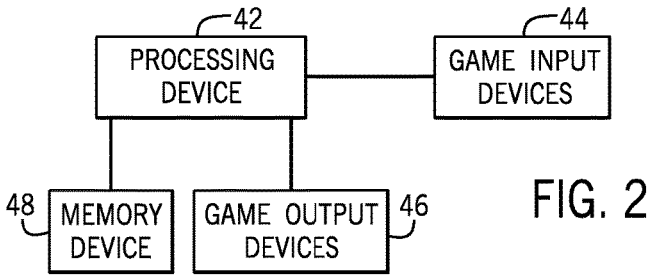
FIG. 2 is an example block diagram of example components of the amusement game device of FIG. 1

Referring to FIG. 2, for controlling the various devices that form the amusement game, the example pinball machine 10 is provided with a processing device 42 which processing device 42 is, in turn, coupled to game input devices 44, such as switches associated with the cabinet 12, playfield 14 (including the target assemblies 24), etc., and game output devices 46, such as lights (including lights associated with target assemblies 24), bumpers 16, flippers 18, display 28, etc. via one or more buss systems. A memory device 48, such as a RAM, ROM, or the like, stores instructions and data usable by the processing device 42 to control play of the game, the game output devices 46, and the game input devices 44 as necessary based upon signals provided by the game input devices 44. It is to be understood that this illustrated embodiment is not intended to be limiting and that other manners for arranging the devices illustrated in FIG. 2 to provide for control of play of the amusement game can be utilized as needed.

Figure 3A:
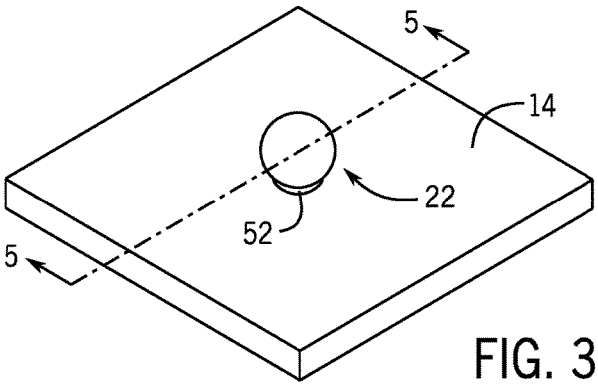
FIGS. 3A, 3B, and 3C are top perspective views illustrating example target assemblies as installed in the example amusement game device.
Figure 3B:
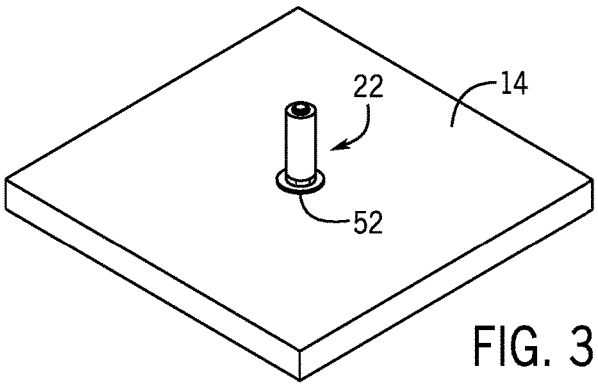
Figure 3C:
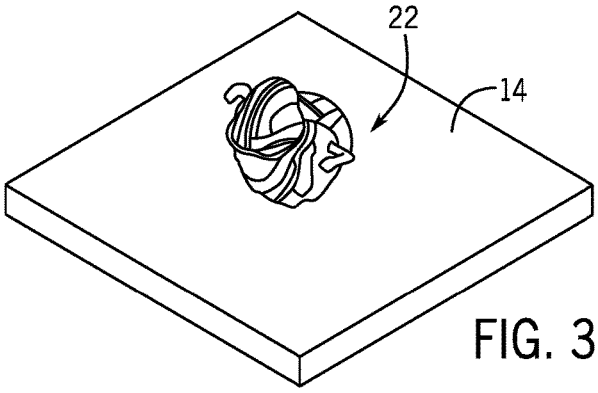

Turning now to FIGS. 3A, 3B, 3C and 4, various examples of the target assembly 24 are illustrated in top perspective and bottom perspective as installed on the playfield 14. Generally, the example target assemblies 24 are mounted within an opening 52 that is formed in the playfield 14. As illustrated in FIG. 3A, the example target assembly 24 includes a "Newton Ball" configuration above the playfield 14, with the remaining components of the target assembly extending below the playfield 14 (i.e., the underside; see FIG. 4). It will be appreciated by one of ordinary skill in the art that while the example target assembly 24 includes a "Newton Ball" attachment, any suitable attachment may be extending above the playfield 14, including for instance, a "Bumper Post" (FIG. 3B), "bash toy" (FIG. 3C), or any other suitable attachment, including lights, etc.

Figure 4:
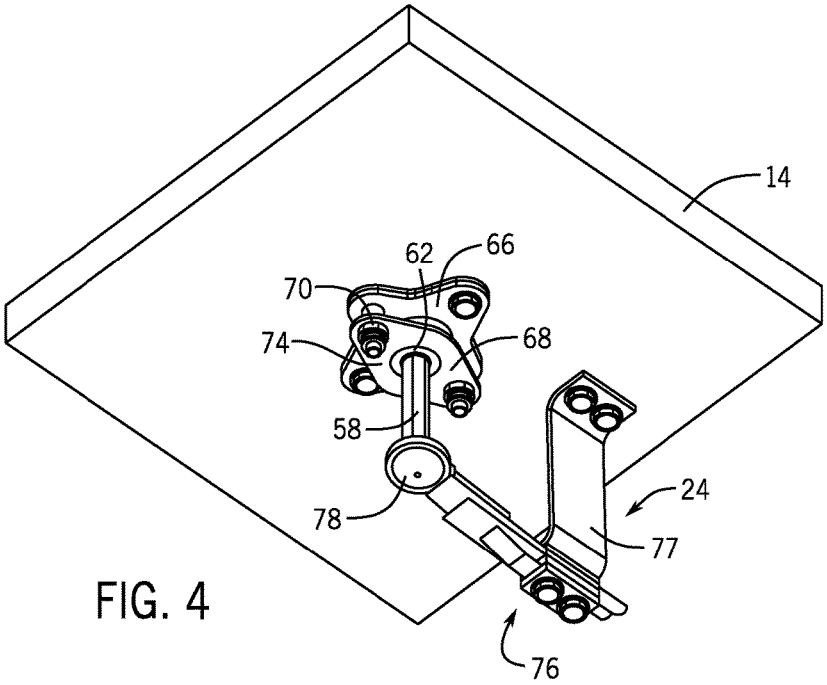
FIG. 4 is a bottom, perspective illustration of the example target assembly of FIG. 3A.
Figure 5:
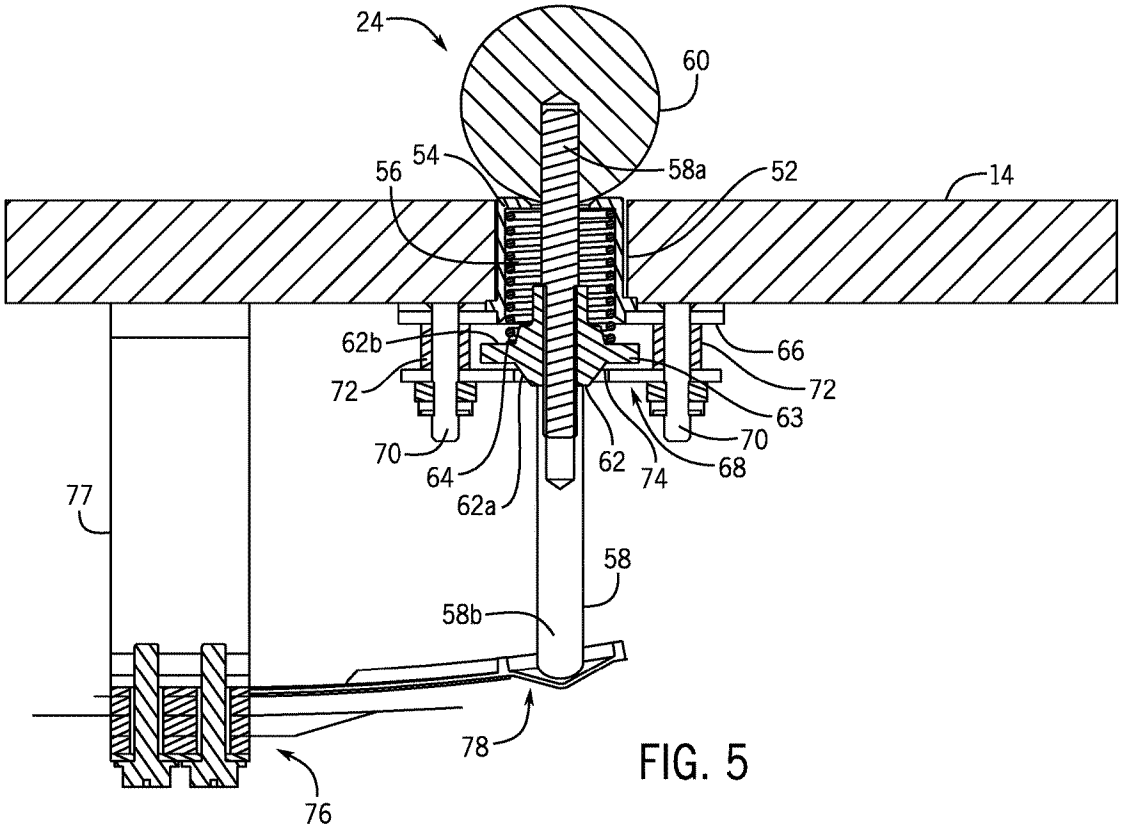
FIG. 5 is a cross sectional view of the example target assembly taken along line 5-5 of FIG. 3A.

To this end, referring to FIGS. 4-9, and more particularly to FIG. 5, the example target assembly 24 comprises a spring retention cup 54 or mounting collar, which is sized to be fit within the opening 52 of the playfield 14 and is adapted to receive a centering spring 56. The retention cup 54 may additionally act as a playfield wear limiter. Extending through the centering spring 56 is a target post 58. The example target post 58 is essentially an elongated post cylinder having a first end 58*a* extending above the playfield 14 and a second end 58*b* extending below the playfield 14. The first end 58*a* of the target post 58 may be configured to be coupled to any suitable attachment 60 such as the example newton ball (shown) or other accessory.

Attached to the target post 58 below the playfield 14 is a centering device, such as for instance a centering cone 62. The example centering cone 62 includes a first end 62*a* distally located from the playfield 14 and is generally frusto-conical in shape. An end 62*b* of the centering cone 62 proximally located near the playfield 14 includes a flange or shoulder 63 extending outward, radially from the target post 58. The example shoulder 63 includes a channel 64 configured to mate with and retain the centering spring 56. A spring cup retention plate 66 and a centering plate 68 are secured to an underside (e.g., a second surface) of the playfield 14 by at least one fastener 70. As disclosed, the spring cup retention plate 66 secures the spring retention cup 54 within the opening 52, while also retaining and maintains the centering cone 62, and thus the target post 58 the proper distance from the playfield 14. A spacer 72 may be provided between the plates 66 and 68 to assist in the maintenance of the proper distance therebetween.

The centering plate 68 defines a centering opening 74 that is coaxially aligned with the opening 52 within the playfield 14. The centering opening 74 is sized to at least partially accept the frusto-conical portion of the centering cone 62, thereby pivotally mounting the target post 58 to the centering plate 68 about a fulcrum. More precisely, when secured to the underside of the playfield 14 by the plates 66 and 68, the centering spring 56 contacts the shoulder 63 to bias the centering cone 62 away from the playfield 14 and thus press the centering cone 62 into the centering opening 74 of the plate 68. In this fashion, the centering cone 62, and thus the target post 58 as biased into a perpendicular alignment with the playfield 14 and will return to the biased position when disturbed therefrom, such as when stuck by the ball 20 during gameplay. It will be appreciated that by varying the positioning and/or construction of the centering cone 62, the centering plate 68, and/or the centering opening 74, the biased position of the target post 58 may be varied as desired.

The second end 58*b* of the target post 58 is operably coupled to a sensing switch 76 coupled to the underside of the playfield 14 by a mounting bracket 77. The sensing switch 76 may be any suitable switch, such as for instance a leaf switch, microswitch, magnetic proximity sensor, opto-electronic sensor, or other suitable sensor switch as desired. In this example, the sensing switch 76 includes a contact plate 78 that is operably coupled to (e.g., contacted by) the second end 58*b* of the target post 58. In operation, as the target assembly 10 is actuated, i.e., the target post 58 is moved from its biased center position (see FIGS. 5 and 6), the sensing plate 78 is moved to trigger the sensing switch 76. The sensing switch 76 is, in turn, operatively coupled to the processing device 42 through any suitable electrical/data buss (not shown), including wiring, etc. as commonly understood in the art.

Figure 6:
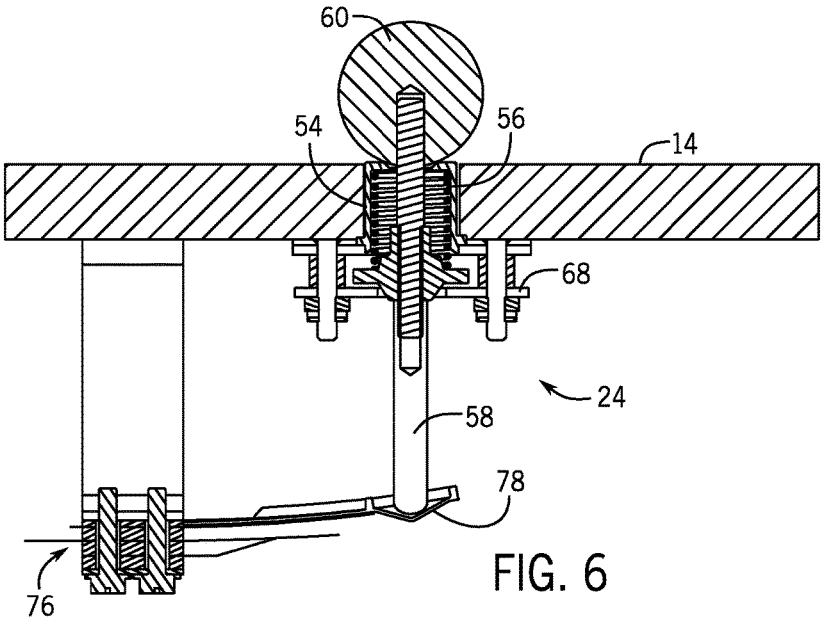
FIGS. 6 and 7 illustrate an example operation of the target assembly of FIG. 5.
Figure 7:
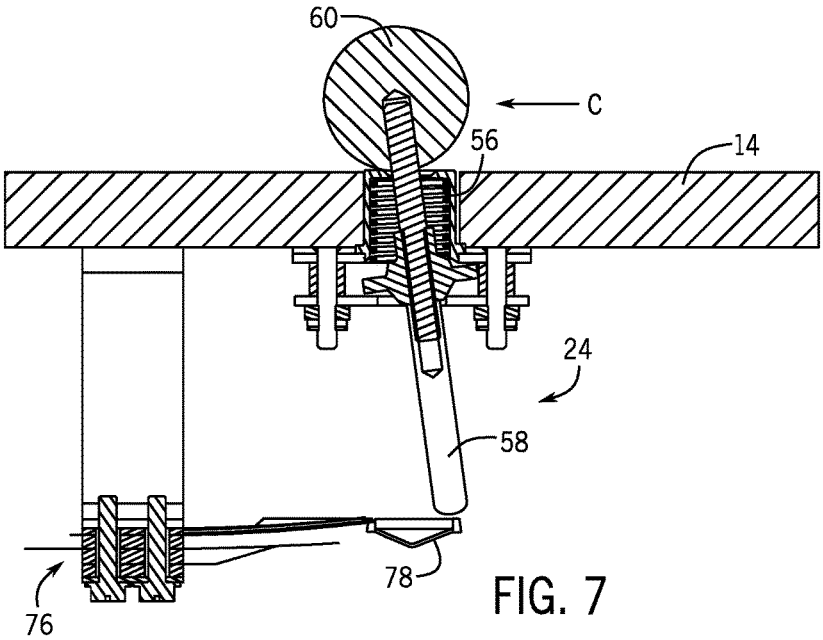

An illustration of the operation of the example target assembly 24 is provided in cross section as FIGS. 6 and 7. More precisely, FIG. 6 illustrates a nominal rest position of the target assembly 24. In this position, as disclosed above, the centering spring 56 provides a biasing force between the retention cup 54 and the shoulder 63 of the centering plate 68 to position the target post 58 in a generally perpendicular orientation relative to the playfield 14.

Meanwhile, FIG. 7 illustrates a typical actuated position of the target assembly. It will be understood that in this example, the target assembly 24 may be actuated in any direction through 360°, e.g., omnidirectional, but the target assembly 24 may be modified and/or provided with different accessories on the playfield 14 to provide for limited directional actuations as desired. As illustrated in FIG. 7, contact with the attachment 60 mounted to the target post 58 in the direction C, such as by the ball 20 during game play, will actuate and pivot the target post 58 away from the nominal position of FIG. 6, and into the actuated position illustrated. It will be understood that the sized of the centering cone 62 in combination with the space provided between the centering plate 68 and the cup retention plate 66 may limit the pivotal movement of the target post 58. For instance, as illustrated when the target post 58 is pivoted, the shoulder on at least one side of the centering cone 62 may contact either or both of the plates 66, 68 to prevent further pivotal movement of the target post 58. In this position, as detailed above, the target post 58 is moved so as to move and/or activate the sensing plate 78 and trigger the sensing switch 76. Once the actuation force is removed, the entire target assembly 24 will return to the nominal position.

Figure 8:
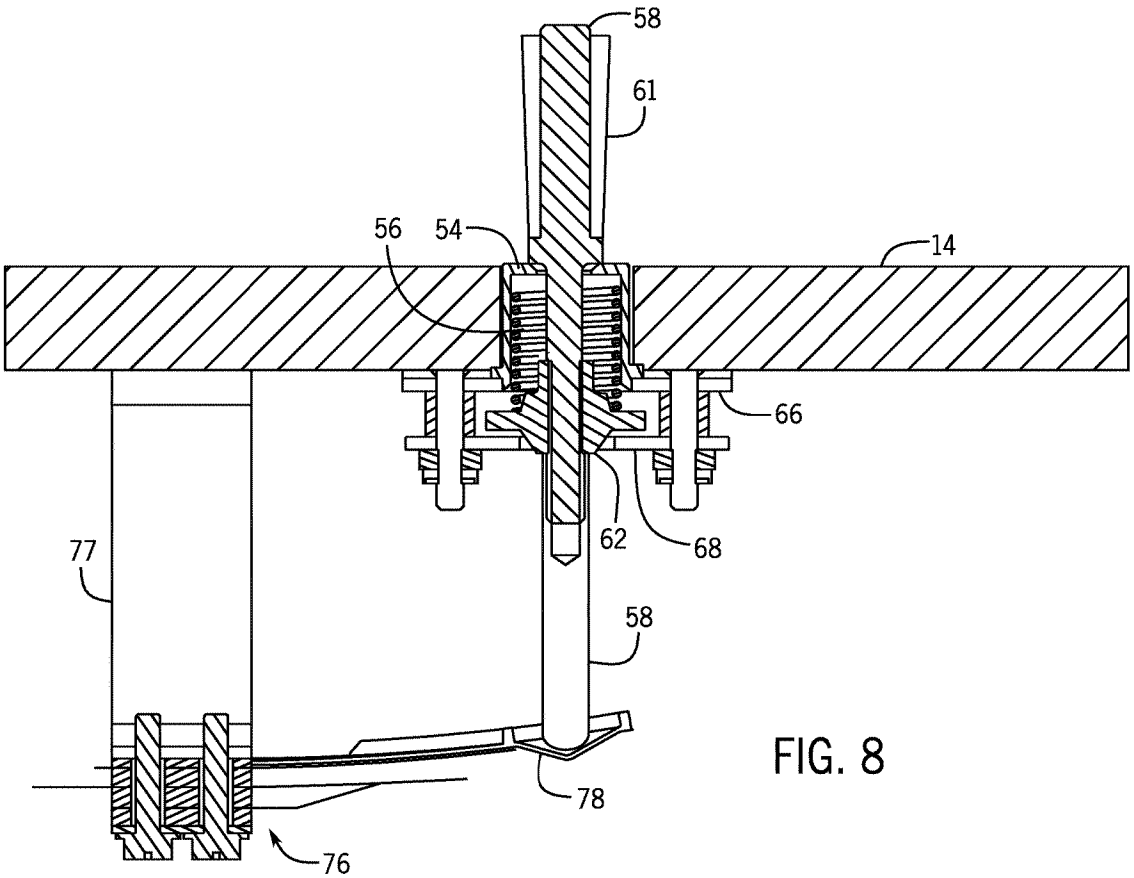
FIG. 8 is a cross sectional view of the example target assembly of FIG. 3B.
Figure 9:
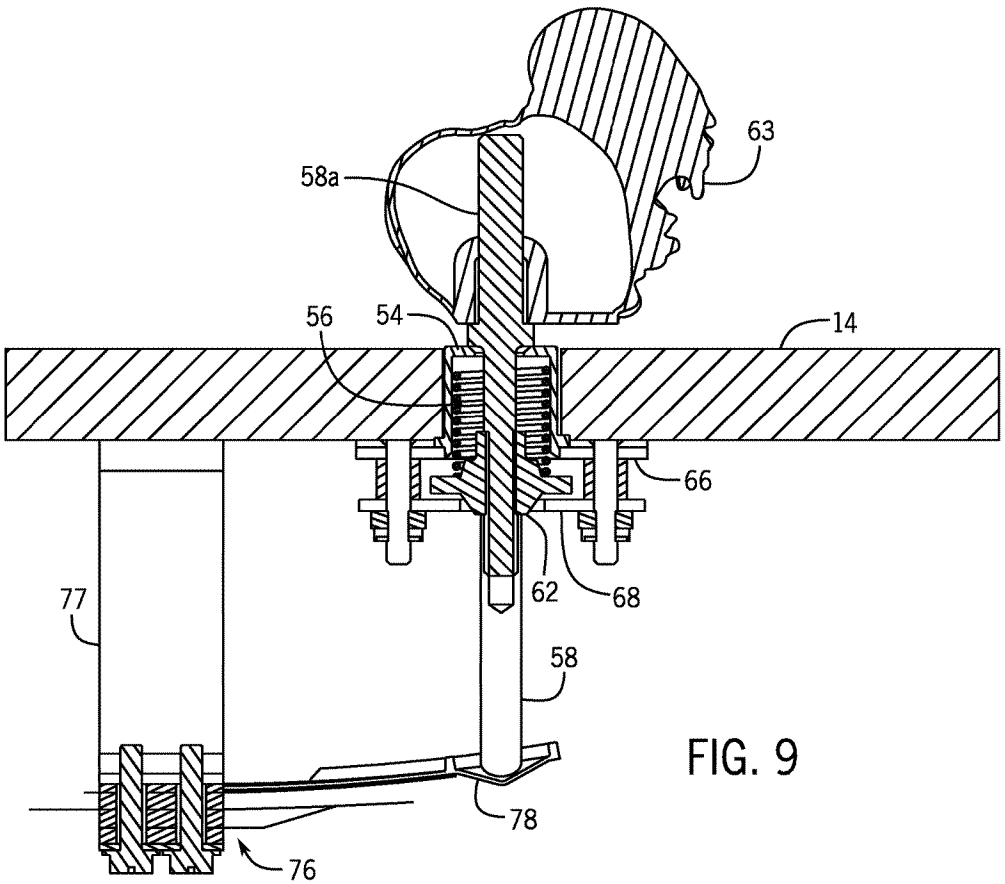
FIG. 9 is a cross sectional view of the example target assembly of FIG. 3C.

FIGS. 8 and 9 illustrate other examples of the target assembly 24, constructed in the same manner as the target assembly 24 of FIG. 4, but with different attachments 60 mounted to their respective target posts 58. For example, FIG. 8 illustrates that the attachment 60 may be a bumper sleeve 61, while FIG. 9 illustrates that the attachment 60 may be a bash toy 63 or other three-dimensional character/accessory.

While specific examples of the present invention have been disclosed in detail, it will be appreciated by one of ordinary skill in the art that that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

We claim:

1. A target assembly for use with an amusement game having a playfield and an object which moves across a first surface of the playfield, comprising:

a target post arranged to be mounted to a second surface of the playfield and sized to extend through an opening formed in the playfield wherein the target post includes a first end extending outward from the first surface and a second end extending outward from the second surface;

a centering device mounted to the target post between the first end of the target post and the second end of the target post, the centering device comprising a shoulder extending radially from the target post;

a centering plate secured to the second surface of the playfield for mounting the target post thereto, the centering plate defining a centering opening sized to allow the target post to extend therethrough and sized to allow the centering device to extend into the centering opening and yet prevent the centering device from passing entirely through the centering opening, the centering plate being spaced from the second surface of the playfield to retain the centering device between the second surface of the playfield and the centering plate and to pivotally mount the target post to the centering plate about a fulcrum;

a biasing element located between the playfield and the shoulder of the centering device to bias the centering device towards the opening of the centering plate; and a sensing switch coupled to the target post to sense movement of the target post.

2. The target assembly according to claim 1, wherein an impact of the target post extending from the first surface of the playfield by the object causes the target post to pivot about the centering device from a nominal rest position to an actuated position, and wherein the biasing element restores the target post from the actuated position towards the nominal rest position when the impact is removed.

3. The target assembly according to claim 1, further comprising a spring retention cup sized to be fit within the opening of the playfield and adapted to receive the centering spring therein.

4. The target assembly according to claim 3, further comprising a spring cup retention plate mounted to the second surface of the playfield between the second surface of the playfield and the centering plate, the spring cup retention plate comprising an opening to allow the target post to pass therethrough.

5. The target assembly according to claim 4, further comprising at least one spacer located between the spring cup retention plate and the centering plate.

6. The target assembly according to claim 1, wherein the sensing switch is a leaf switch and the sensing switch comprises a contact plate operably coupled to the second end of the target post, wherein movement of the contact plate is sensed by the sensing switch.

7. The target assembly according to claim 1, wherein the sensing switch is one of a leaf switch, a microswitch, a magnetic proximity sensor, or an opto-electronic sensor.

8. The target assembly according to claim 1, wherein a portion of the centering device extending into the centering opening is frusto-conical.

9. The target assembly according to claim 1, wherein the biasing element is a helical spring.

10. The target assembly according to claim 1, wherein the target post passes through the biasing element.

11. The target assembly according to claim 1, wherein the shoulder comprises a channel for receiving the biasing element.

12. The target assembly according to claim 1, further comprising an attachment mounted to the first end of the target post.

13. The target assembly according to claim 1, wherein the target post pivots about the centering device in any of 360 degrees.

14. An amusement game, comprising:

a playfield having a first surface, a second surface, and an opening that extends between the first surface and the second surface;

an object which moves across the first surface of the playfield; and a target assembly, comprising:

a target post arranged to be mounted to a second surface of the playfield and sized to extend through the opening in the playfield, the target post comprising a first end extending outward from the first surface and a second end extending outward from the second surface;

a centering device mounted to the target post between the first end of the target post and the second end of the target post;

a centering plate secured to the second surface of the playfield for mounting the target post thereto, the centering plate defining a centering opening sized to allow the target post to extend therethrough and sized to allow the centering device to extend partially into the centering opening and yet prevent the centering device from passing entirely through the centering opening, the centering device and centering opening cooperating to pivotally mounting the target post to the centering plate;

a biasing element biasing the centering device into the opening of the centering plate; and a sensing switch coupled to the second end of the target post to sense pivotal movement of the target post caused by impact of the target post extending from the first surface of the playfield by the object, wherein impact of the target post by the object causes the target post to pivot about the centering device from a nominal rest position to an actuated position, and wherein the biasing element restores the target post from the actuated position to the nominal rest position when the impact is removed.

15. The amusement game of claim 14, further comprising a mounting collar sized to be fit within the opening of the playfield and adapted to receive the biasing element therein.

16. The amusement game of claim 15, further comprising a retention plate mounted to the second surface of the playfield between the second surface of the playfield and the centering plate, the retention plate comprising an opening to allow the target post and biasing element to pass therethrough and to retain the mounting collar within the opening.

17. The amusement game of claim 14, wherein the sensing switch comprises a contact plate operably coupled to the second end of the target post, wherein pivotal movement of the contact plate is sensed by the sensing switch.

18. The amusement game of claim 14, wherein a portion of the centering device extending into the centering opening is frusto-conical.

19. The amusement game of claim 14, wherein the biasing element is a helical spring.

20. The amusement game of claim 14, wherein the target post pivots about the centering device in any of 360 degrees.

21. An omnidirectional target assembly for an amusement game comprising:

a target post extending through an opening in a playfield of the amusement game with a portion of the target post extending above the playfield and a portion of the target post extending below the playfield;

a centering device radially mounted to the target post on the portion of the target post extending below the playfield;

a centering plate secured to an underside of playfield, the centering plate defining an opening for allowing the target post to extend therethrough, the opening being operably coupled with the centering device to form a fulcrum for the target post to pivot as a lever;

a biasing element to bias the target post into a nominal rest position; and a sensing switch operable coupled to the target post to detect movement thereof, wherein impact of a ball with the portion of the target post extending above the playfield causes the target post to pivot about the fulcrum, and wherein the biasing element biases the impacted target lever towards the nominal rest position after impact by the ball.

* * * * *